US008474883B2

(12) United States Patent
Konchan et al.

(10) Patent No.: US 8,474,883 B2
(45) Date of Patent: Jul. 2, 2013

(54) LATCHING MECHANISM

(75) Inventors: Jeffrey L. Konchan, Romeo, MI (US); Louis J. Conrad, Attica, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 144 days.

(21) Appl. No.: 12/849,402

(22) Filed: Aug. 3, 2010

(65) Prior Publication Data

US 2012/0032454 A1 Feb. 9, 2012

(51) Int. Cl.

| | |
|---|---|
| ***E05B 65/10*** | (2006.01) |
| ***E05C 19/06*** | (2006.01) |
| ***E05C 3/06*** | (2006.01) |
| ***E05C 3/16*** | (2006.01) |

(52) U.S. Cl.

USPC ..... 292/92; 292/216; 292/20; 292/DIG. 22; 292/DIG. 23; 292/DIG. 65

(58) Field of Classification Search

USPC ..... 292/92, 216, 20, 1, 95, 203, 207, 292/210, DIG. 22, DIG. 65, DIG. 11

See application file for complete search history.

(56) References Cited

U.S. PATENT DOCUMENTS

| | | | | | |
|---|---|---|---|---|---|
| 4,941,696 | A * | 7/1990 | Yamada et al. | ..... | 292/340 |
| 5,064,229 | A * | 11/1991 | Hamada et al. | ..... | 292/216 |
| 5,253,906 | A * | 10/1993 | Rogers et al. | ..... | 292/216 |
| 5,727,825 | A * | 3/1998 | Spurr | ..... | 292/341.12 |
| 5,961,164 | A * | 10/1999 | Gomi | ..... | 292/216 |
| 5,979,971 | A * | 11/1999 | Mizuki et al. | ..... | 296/155 |
| 6,305,727 | B1 * | 10/2001 | Bland | ..... | 292/216 |
| 6,382,686 | B1 * | 5/2002 | Ishigaki et al. | ..... | 292/201 |
| 6,406,073 | B1 * | 6/2002 | Watanabe | ..... | 292/216 |
| 6,866,226 | B2 * | 3/2005 | Pratt et al. | ..... | 244/129.4 |
| 2006/0012184 | A1 * | 1/2006 | Ottesen et al. | ..... | 292/216 |
| 2006/0208506 | A1 * | 9/2006 | Kern et al. | ..... | 292/304 |
| 2011/0025077 | A1 * | 2/2011 | Meyer et al. | ..... | 292/216 |

* cited by examiner

*Primary Examiner* — Thomas Beach
*Assistant Examiner* — Faria Ahmad
(74) *Attorney, Agent, or Firm* — Quinn Law Group

(57) ABSTRACT

A latching system for and a method of latching a first member to a second member are provided. The latching system includes a latching mechanism including a displaceable feature which, when operatively displaced, allows a striker to engage with a housing of the latching mechanism, at a recess defined by the housing, to provide supplementary or auxiliary latching force. The displaceable feature may be displaced by an actuating load transmitted between the striker and the latching mechanism, where the actuating load is substantially greater than the nominal load experienced by the latching system during ordinary latching conditions. The engagement of the striker with the housing at the recess may transfer a portion of the actuating load to the housing during the event generating the actuating load, thereby increasing the latching strength of the latching system and reducing the potential for deformation or distortion of the latching element during the event.

20 Claims, 4 Drawing Sheets

LATCHING MECHANISM

TECHNICAL FIELD

The present invention relates to a latching mechanism.

BACKGROUND

A latching mechanism is typically configured to include a latching element, for example, a pawl, which is engageable to a striker. The latching mechanism may be attached to a first member and the striker may be attached to a second member such that the engagement of the latching element to the striker provides a latching force to latch the first member to the second member. The latching force provided by the engagement of the striker and the latching element must be sufficient to latch the first member to the second member under nominal or ordinary loading conditions. The latching mechanism, striker or pawl may be subject to higher loading conditions, e.g., in excess of nominal loading conditions, which may be experienced, for example, during an impact event. These higher loading conditions may require that the latching system be configured to provide a latching force responsive to the higher loading conditions by, for example, increasing the size and strength of the latching and striker elements, which may result in a latching system characterized by increased cost, weight and size and increased packaging space requirements.

SUMMARY

A latching mechanism is described herein including a displaceable feature which, when operatively displaced, allows engagement of a striker with the housing of the latching mechanism, at a recess defined by the housing to provide an additional latching force, which may be referred to as an auxiliary or supplementary latching force. The displaceable feature may be operatively displaced by an actuating load transmitted between the striker and the latching mechanism, where the actuating load is substantially greater than the nominal load experienced by the latching system during ordinary latching conditions. The engagement of the striker with the recess may transfer at least a portion of the actuating load to the housing during the event generating the actuating load, thereby increasing the latching strength of the latching system and reducing the potential for deformation or distortion of the latching element during the event.

A latching system is provided, including a striker and a latching mechanism. The latching mechanism includes a housing, a displaceable element, and a latching element. The latching element is configured to be selectively engageable with the striker, such that the engagement of the latching element and the striker provides a latching force, which may be referred to as a main or primary latching force, to engage the striker to the latching mechanism. The housing defines a recess configured to be engageable with the striker. The recess may be configured, for example, as one of a notch, an indentation, a groove, a U-shape, a J-shape, an L-shape, and an arc shape.

The displaceable element is configured to be operatively displaceable from a first position to a second position. In the first position the displaceable element prevents the striker from entering the recess, and in the second position the striker is engageable with the housing at the recess such that the housing provides an auxiliary or supplementary latching force. The displaceable element may be operatively displaced from the first position to the second position by an actuating force transmitted between the striker and the displaceable element, and a portion of the actuating force may be transmitted through the housing when the striker and the recess engage. The displaceable element in the first position may be proximate to the recess, may be operatively attached to the housing, may be defined by the housing and/or may be non-metallic. The striker may be proximate to the displaceable element when the striker and the latching element are engaged and the displaceable element is in the first position. The displaceable element may be operatively displaced from the first position to the second position by operatively detaching the displaceable element, partially or fully, from the latching mechanism, and/or by operatively deforming the displaceable element.

In a non-limiting example, a door latching system for a vehicle is provided, the vehicle having a vehicle body including a door interface portion and a door. The door latching system includes a striker adapted to be operatively connected to one of the door and the door interface portion, and a latching mechanism adapted to be operatively connected to the other of the door and the door interface portion. The latching mechanism includes a housing, a latching element, and a displaceable element, and may be configured as discussed herein, such that engagement of the latching element and the striker provides a latching force to operatively latch the door assembly to the door interface portion, and such that the striker is in the recess when the displaceable element is in the second position, such that the housing provides an auxiliary or supplementary latching force to operatively latch the door assembly to the door frame portion.

A method to provide additional latching force to latch a first member to a second member is described herein. The method includes operatively attaching a striker to one of the first member and the second member and operatively attaching a latching mechanism to the other of the first member and the second member, wherein the latching mechanism may be configured as described herein. The method further includes providing the displaceable element in a first position, engaging the latching element and the striker to provide a latching force to latch the first member to the second member, operatively displacing the displaceable element from the first position to a second position such that the striker enters the recess, and engaging the striker with the housing at the recess to provide an auxiliary or supplementary latching force to latch the first member with the second member. The method may further include operatively displacing the displaceable element from the first position to the second position by transmitting an actuating force between the striker and the displaceable element. In a non-limiting example, the first member may be one of a vehicle door and a vehicle body, and the second member may be the other of a vehicle door and a vehicle body.

The advantages of the latching system described herein include, for example, integration of the recess feature into the existing latching mechanism housing to provide a supplementary latching element, with minimal, if any, increase in cost, minimal, if any, increase in size of the housing, and minimal impact on packaging space requirements, and by providing an actuating element which is actuated by an inputted load only, without requiring the cost, weight or complexity of additional actuating mechanisms.

The above features and other features and advantages of the present invention are readily apparent from the following detailed description of the best modes for carrying out the invention when taken in connection with the accompanying drawings.

DETAILED DESCRIPTION

Figure 1:
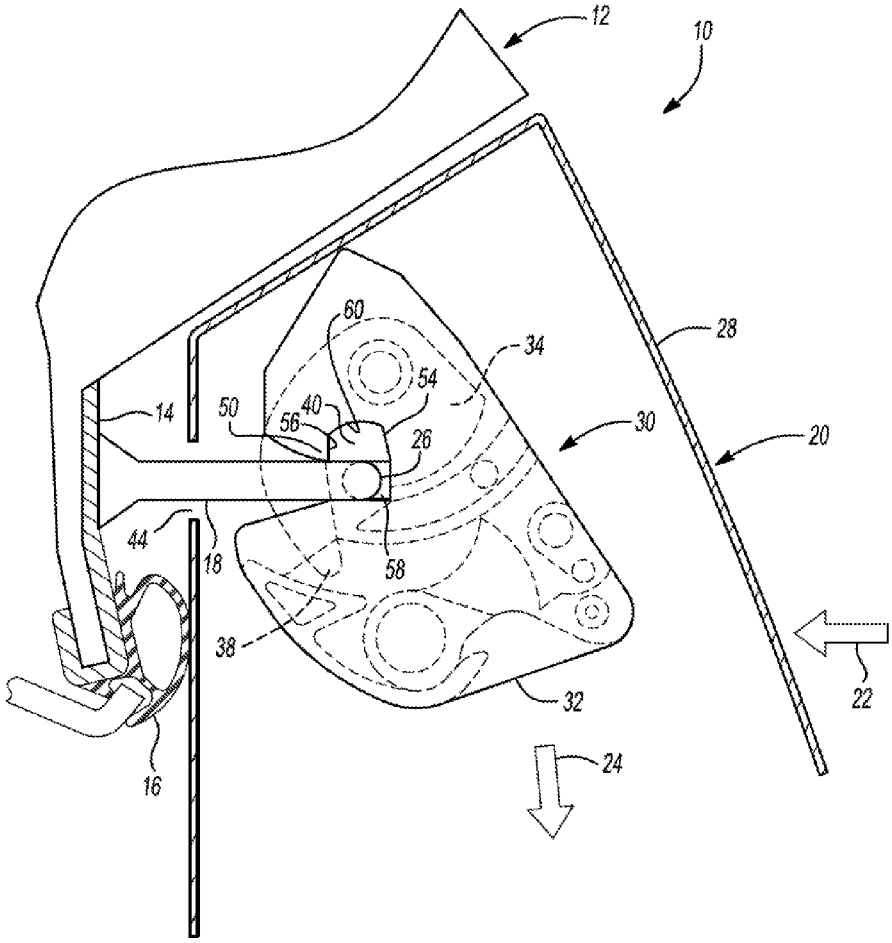
FIG. 1 is a partial sectional schematic view of a vehicle door system including a latching mechanism engaged with a striker, the latching mechanism including a displaceable element.

Referring to the drawings wherein like reference numbers represent like components throughout the several figures, and beginning with FIG. 1, a portion of a vehicle 10, including a door latching system, is shown. The elements shown in FIGS. 1-7 are not to scale. Accordingly, the particular dimensions and applications provided in the drawings presented herein are not to be considered limiting. Vehicle 10 includes a door 20, which may also be referred to as a first member 10, defined by a door shell or outer structure 28, and further includes a door interface portion 12, which may also be referred to as a second member 12, which may be a portion of the body of vehicle 10 or may be another door to which the door 20 may be sealed or latched. A latching system is shown, including a latching mechanism 30 and a striker 18. The latching mechanism 30 and striker 18 operatively engage to provide a latching force to operatively latch a first member 20 to a second member 12. In the non-limiting example shown in FIG. 1, the first member is shown as the door 20 and the second member is shown as the door interface portion 12 of a vehicle 10. The door interface portion 12 may be for example, a portion of a vehicle door frame, a door rail, a head rail, a roof rail or other portion of the body of a vehicle 10 which provides a mounting surface 14 for operatively attaching the striker 18. Door interface portion 12 may also be another vehicle door to which the door 20 is sealed or latched, which provides a mounting surface 14 for operatively attaching the striker 18. The mounting surface 14 may be integral to or operatively attached to the door interface portion 12. The striker 18 is operatively connected or fixedly attached to the mounting surface 14, which is shown in FIG. 1 as a striker base plate. The striker 18, which may also be referred to as a striker element, a striker loop, a fork-bolt or a catch, may be of various configurations, and is adapted to be operatively connected to one of the door 20 and the door interface portion 12. In the non-limiting example shown, the striker 18 is configured to include a striker bolt, fork-bolt, or pin portion 26 and is operatively attached at one or more attachment interfaces to striker base plate 14. The mounting surface or striker base plate 14 may be attached to the door interface portion 12 by bolts, rivets or other suitable means of fastening, such that the striker 18 is operatively attached to the door interface portion 12. The door interface portion 12 may further include a sealing element 16 which is compressed between the door 20 and the door interface portion 12 when the latching mechanism 30 and the striker 18 are engaged.

The latching mechanism 30 is adapted to be operatively connected to one of the door 20 and the door interface portion 12. As shown in FIG. 1, the latching mechanism 30 is operatively attached to the door 20 proximate to an opening 44 defined by the door shell 28. The latching mechanism 30 includes a housing 32 which defines a channel or approach path 58, shown in additional detail in FIG. 2, for presentation of the striker 18 to a latching element 34 of latching mechanism 30. The latching mechanism 30 may be operatively attached to the door 20, for example, by fixedly attaching the housing 32 to the door shell 28, by bolts, rivets, or other suitable means of fastening. Opening 44 is defined by the door 20. The latching mechanism 30 is operatively attached to the door 20 such that the striker 18 is aligned with the opening 44 and the channel or approach path 58 (see FIGS. 2-3) when the door 30 is presented to the door interface portion 12 and the striker 18 for latching. When the door 20 is closed in a direction 22, the striker 18 is presented through the opening 44 to the approach path 58. The latching mechanism 30 operates to engage the latching element 34 to the striker 18 to provide a latching force F1 (see FIG. 4) by engaging the striker 18 to the latching mechanism 34 and to operatively latch the door 20 to the door interface portion 12. The latching element 34, in the non-limiting example shown in FIG. 1, is configured as a pawl 34 defining a tongue, fork or ratchet 38 which engages the bolt 26 of the striker 18 when latched. The latching mechanism 30 includes other elements shown in broken lines in FIG. 1 which interact with the pawl 34 to actuate the pawl 34 to engage with the striker 18 when the door 20 is closed and latched, and to disengage with the striker 18 when the door 20 is unlatched and opened, as would be understood by those skilled in the art.

Figure 2:
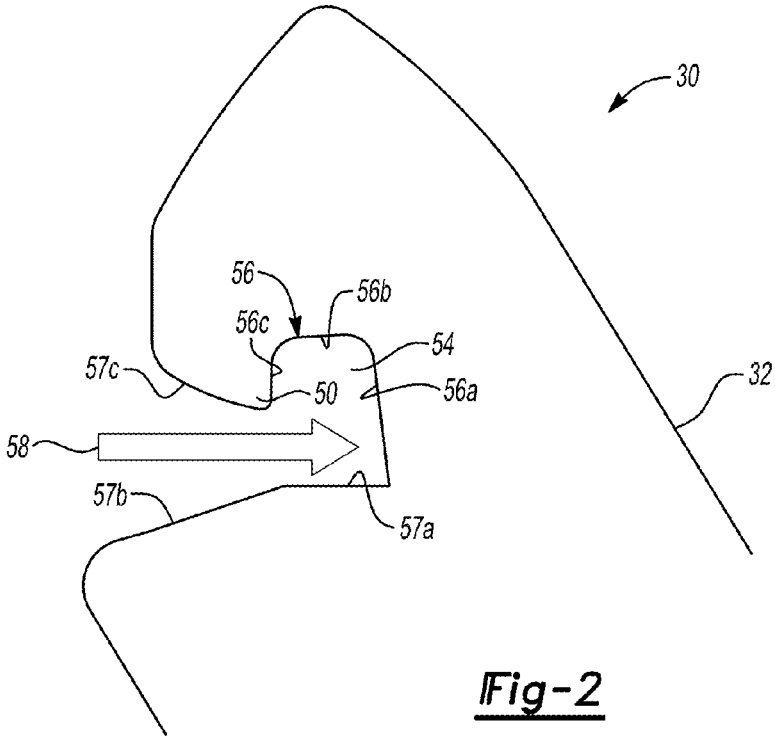
FIG. 2 is a schematic illustration of the housing of the latching mechanism of FIG. 1.

As will be described further related to FIGS. 2-7, the latching mechanism 30 further includes a displaceable element 40, which as shown in a first position in the non-limiting configuration shown in FIGS. 1, 3, 4 and 5, partially defines the approach path 58 (see FIG. 3). The housing 32 includes a recess 54 which, as shown in FIG. 2, is defined by a perimeter 56 consisting of perimeter portions 56*a*, 56*b* and 56*c*. In the first position, the displaceable element 40 is configured to prevent the bolt 26 of the striker 18 from entering the recess 54 of the housing 32 under nominal or ordinary loading and latching conditions (see FIG. 4). As referred to herein, nominal or ordinary conditions are those conditions which are experienced by the latching system during every day or ordinary operation, for example, during ordinary opening and unlatching and closing and latching of the door 20, where the typical or ordinary closing direction of the door is represented by an arrow 22 (see FIGS. 1 and 4), and where the typical or ordinary opening direction of the door is represented by an arrow 23 (see FIGS. 4, 6 and 7). Under nominal conditions, the latching element 34 and the striker 18 engage to provide a latching force F1 (see FIG. 4) which opposes the opening of the door 20 in a direction generally opposite the arrow 22, e.g., generally in the direction of arrow 23. The latching force F1 provided by the engagement of the latching element 34 and the striker 18 may also be described as a primary or main latching force. Further, under nominal conditions, minimal force is exerted in a direction 24 on the latching system, being countered, for example, by a hinging mechanism or other means (not shown) operatively attaching the non-latching end of door 20 to the body of vehicle 10.

Figure 6:
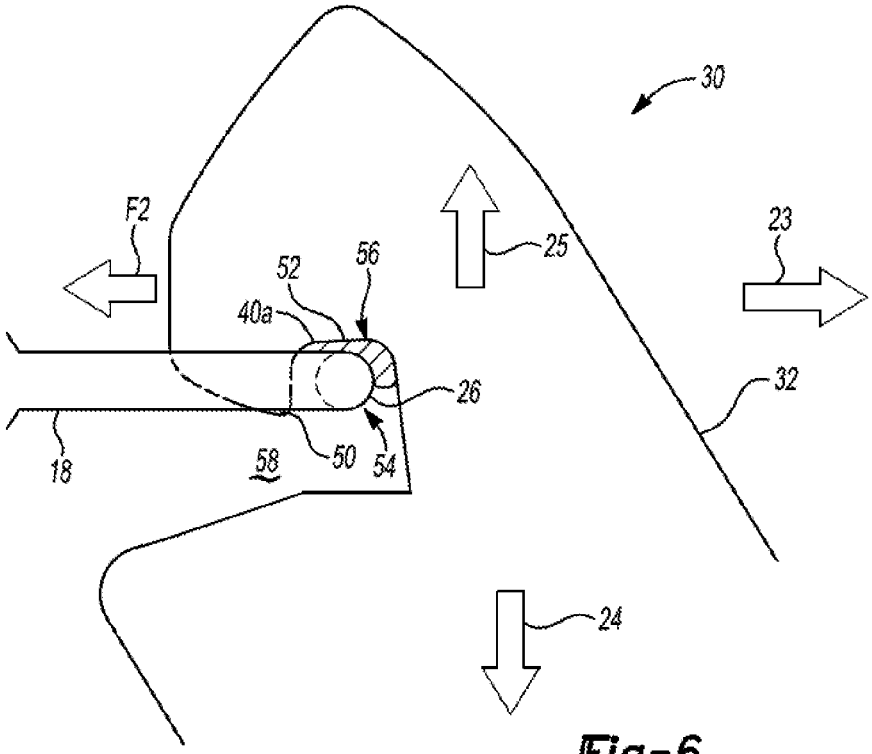
FIG. 6 is a schematic illustration of the housing with the displaceable element displaced and including the striker engaged with the housing recess.
Figure 7:
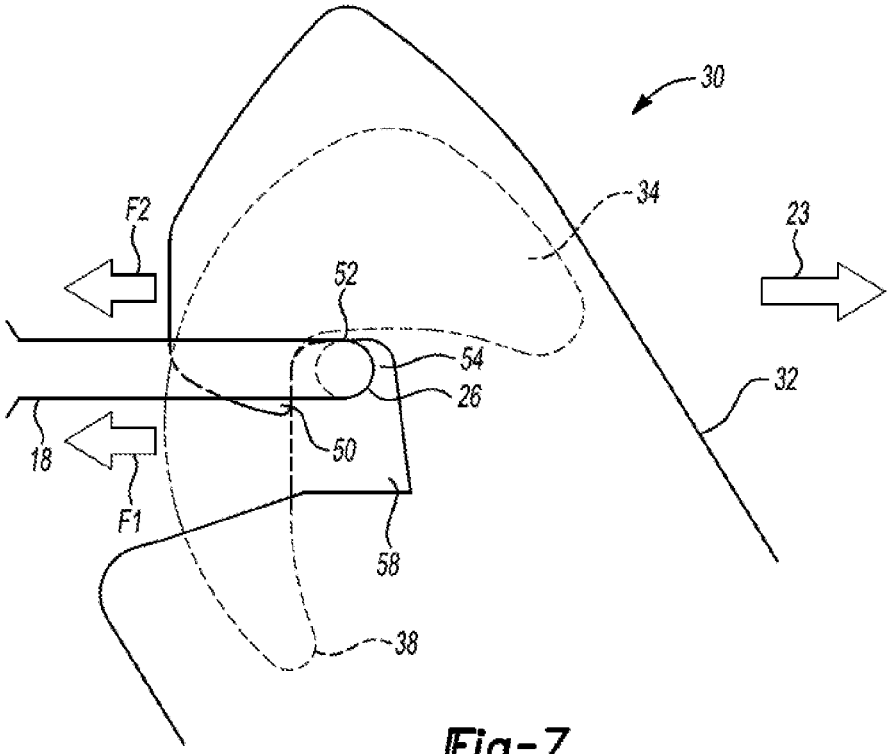
FIG. 7 is a schematic illustration of the latching mechanism showing the striker engaged with the latching element and the recess of the housing.

The latching system, including the latching mechanism 30 and the striker 18, may be subject to higher loading conditions, e.g., in excess of nominal or ordinary loading conditions, which may be experienced, for example, during an impact event. These higher loading conditions may create a greater than nominal loading force in a direction 22 or a direction 24, or a combination thereof, such that these higher loads are transmitted through the latching system. The latching system described herein is configured to provide an auxiliary or supplementary latching force responsive to the higher loading conditions by displacing the displaceable element 40, as shown in FIG. 5, and thereby engaging the striker 18 with the housing 32 at the recess 54, as shown in FIG. 6. The striker 18 and the latching element 34 are configured to remain engaged when the striker 18 engages the housing 32 at the recess 54, as shown in FIG. 7, such that the supplementary or auxiliary latching force F2 (see FIGS. 6 and 7) provided by the engagement of the striker 18 with the housing 32 at the recess 54 may be provided in addition to the main latching force F1 (see FIGS. 4 and 7) provided by the engagement of the striker 18 with the latching element 34. Alternatively, if the latching element 34 and the striker 18 partially or fully disengage, the engagement of the striker 18 with the housing 32 at the recess 54 provides an auxiliary or substitute latching force to latch the latching mechanism 30 to the striker 18. Further, the engagement of the striker 18 with the housing 32 at the recess 54 results in at least a portion of the higher load to be transferred to the housing 32 thereby reducing the load transferred through the latching element 34 and reducing the potential for deformation or distortion of elements of the latching mechanism during the higher loading event, by dissipating the higher load through, for example, the housing 32.

FIGS. 2-7 show the latching system including the latching mechanism 30 and the striker 18 in additional detail. As shown in FIG. 2, housing 32 includes a recess defined by a perimeter 56 which is defined by perimeter sections 56*a*, 56*b* and 56*c*. The recess 54 may also be partially defined by a hook portion 50 of housing 32. Hook portion 50 may be defined, for example, by perimeter portion 56*c* and approach path portion 57*c*, as shown in FIG. 2. The hook 50 may be configured to contain the striker 18 in the recess 54 or to deter disengagement or displacement of the striker 18 from the recess 54. The housing 32 at recess 54 and/or the hook 50 may define an opening from the recess 54 to the approach channel 58 through which the striker 18 can move to engage with the housing 32 at the recess 54. The recess 54, in the non-limiting example shown in FIG. 2, is configured generally as a U-shape notch. The recess 54 may be configured as one of a notch, an indentation, a groove, a U-shape, a J-shape, an L-shape, an arc shape or other shape as would be suitable to engage the striker 18 in the housing 32 at the recess 54 (see FIG. 6).

FIG. 2 shows the approach path 58 through which the striker 18 enters or is presented to the housing 32 and the latching mechanism 30. In the non-limiting configuration shown in FIG. 2, surfaces 57*a*, 57*b* and 57*c* of the housing 32 define the approach path 58. Further, as shown in FIG. 3, displaceable element 40 or surface 42 of element 40 may partially define the approach path 58.

Figure 3:
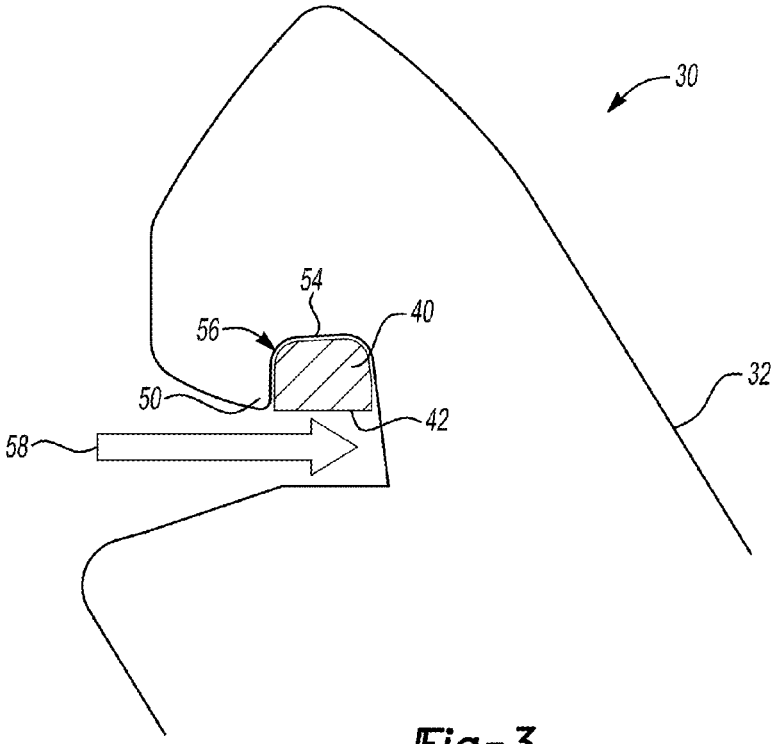
FIG. 3 is a schematic illustration of the housing of FIG. 2, including a displaceable element in a first position.
Figure 4:
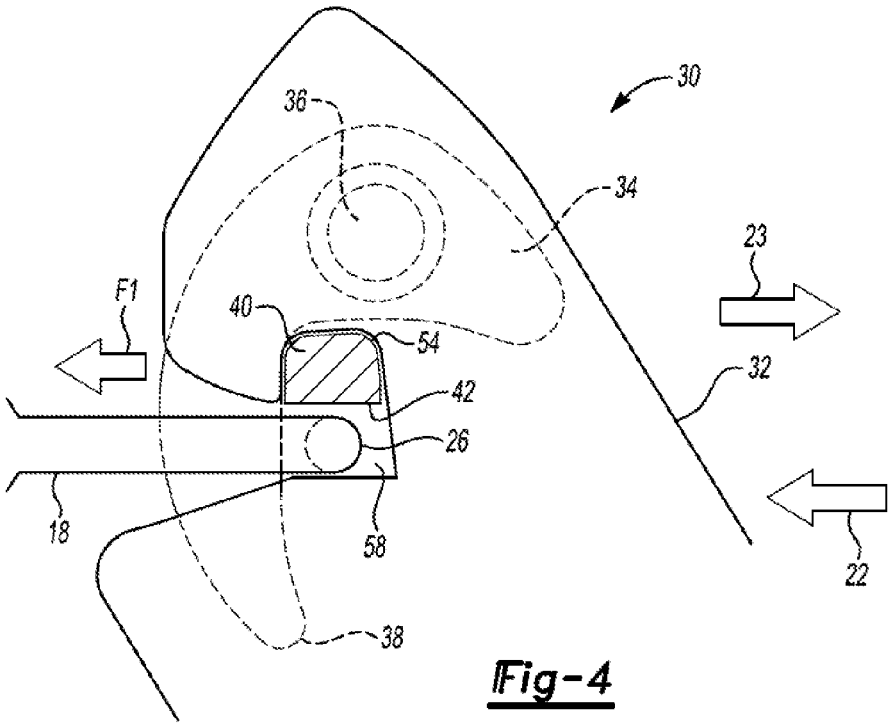
FIG. 4 is a schematic illustration of the latching mechanism of FIG. 1 including a displaceable element and with the latching element engaged with the striker.
Figure 5:
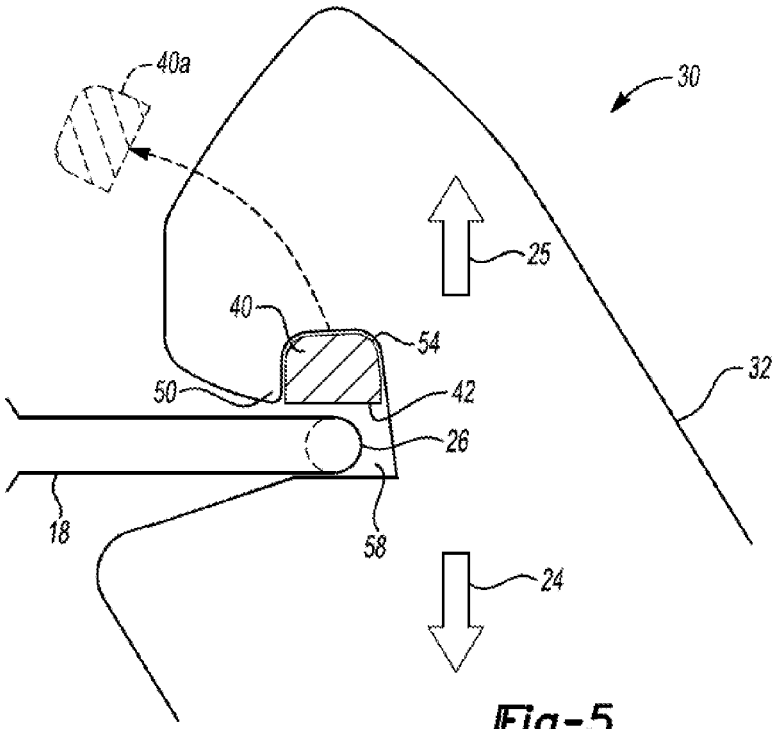
FIG. 5 is a schematic illustration of the housing of FIG. 2 and a striker.

The displaceable element 40 is shown in FIGS. 3-5, in a non-limiting example configuration, in a first position wherein the displaceable element 40 is configured to partially define the approach path 58 so as to prevent the striker 18 from engaging with the housing 32 at the recess 54 when the striker 18 is positioned in or presented to the approach path 58. During ordinary operation of the latching mechanism 30, the displaceable element 40 prevents the striker 18 from entering into the recess 54 to support smooth operation of the latching system during ordinary or nominal latching and unlatching events. In a second position (shown by 40*a* in FIGS. 5-6), the displaceable element 40 is operatively displaced from the first position and from the housing 32 and/or the latching mechanism 30 such that the striker 18 is engageable with the housing 32 at the recess 54, as shown in FIG. 6, and such that the engagement of the striker 18 and the housing 32 at the recess 54 provides a supplementary latching force F2 to engage the striker 18 to the latching mechanism 30. The displaceable element 40 in the first position may be proximate to the recess 54, e.g., the displaceable element 40 in the first position may be sufficiently proximate to the recess 54 such that it is in proximate contact with a portion of the striker 18, which may be the bolt portion 26 of the striker 18, to prevent the striker 18 from engaging with the recess 54.

As shown in the non-limiting example of FIGS. 3-4, the displaceable element 40 may be operatively attached or be proximate to the latching mechanism 30 in a first position in any location or configuration such that the displaceable element 40 prevents the striker 18 from entering the recess 54. For example, the displaceable element 40 may be an insert or separate element which is operatively connected to, affixed or attached to a portion of the housing 32, for example, at the recess 54, a portion of the perimeter 56, the hook 50 or any other suitable surface of the housing 32. The displaceable element 40 may be configured to be substantially similar in shape to the shape of the recess 54 or to a portion of the shape of the recess 54, for example, the displaceable element 40 may be configured as an insert to the recess 54 or may be defined by the perimeter 56 or a portion 56*a*, 56*b*, 56*c* thereof and a portion of the hook 50. The displaceable element 40 may be configured such that the displaceable element 40 has a portion or a surface 42 which is proximate to the bolt 26 or the striker 18 to prevent entry into the recess 54 and is configured to overlap or be coincident with the opening of the recess 54 to the approach path 58. The surface 42, when displaceable element 40 is in a first position, may partially define the approach path 58. The displaceable element 40 may be proximate to the latching mechanism 30 in a first position by being positioned adjacent to, for example, recess 54 of housing 32 or in any other location such that displaceable element 40 prevents the striker 18 from entering the recess 54. For example, the displaceable element 40 may be operatively attached to shell 23 proximate to latching mechanism 30.

The displaceable element 40 may be metallic, non-metallic or a combination thereof suitably configured to resist displacement below an actuating force, which may be a predetermined force, to prevent the striker 18 from entering the recess 54, and to be displaceable above the actuating force such that the striker 18 is engageable with the housing 32 at the recess 54. By way of non-limiting example, the displaceable element 40 may be a metal, plastic, polymer, ceramic, or combination thereof, and may be configured as a clip, an insert, a plate, a band, a wire, a tab, a finger, an extension, or another suitable shape. The displaceable element 40 may also be referred to as a breakable, distortable, or deformable element or feature.

The displaceable element 40 may be operatively connected or attached to the latching mechanism 30 by any suitable means such that the displaceable element 40 in a first position prevents the striker 18 from moving into the recess 54 when subjected to less than an actuating force. For example, the displaceable element 40 may be operatively connected to a feature of the latching mechanism 30 or the housing 32 by one or a combination of clipping, welding, riveting, fastening, bonding, brazing, soldering, adhering, press fitting, and inserting the displaceable element 40 into or onto a feature of the latching mechanism 30 or the housing 32, where the method and/or configuration of connection or attachment is provided such that, when the displaceable element 40 is subjected to an actuating force, it is sufficiently displaced, for example, by one or a combination of detaching, breaking, deforming or distorting the displaceable element 40 to a second position, shown in a non-limiting example by element 40*a* in FIGS. 5 and 6, to allow movement of the striker 18 into the recess 54.

Further, the displaceable element 40 may be defined by the housing 32 as an integral feature of the housing 32. For example, the displaceable element 40 may be a portion of the housing 32 which is of reduced cross-section of sufficient strength to prevent the striker 18 from engaging with the housing 32 at the recess 54 below an actuating force, however of reduced strength relative to other portions of the housing 32 such that when subjected to loading conditions above an actuating load, the displaceable element portion 40 of the housing 32 deforms or distorts to a second position to allow the striker 18 to move into the recess 54. The displaceable element 40 may be a portion of the housing 32 which is defined by a living hinge, a perforation, a scribed, scored, or otherwise actuable seam, or a perimeter or a portion thereof of reduced strength, or a combination thereof, for example, which when subjected to loading conditions above an actuating load, is sufficiently displaced from a first position by deformation or distortion to a second position which allows the striker 18 to engage the housing 32 at the recess 54. Further, the recess 54 may be dynamically formed by distorting or deforming the displaceable portion 40 to a second position during the loading event, for example, by contact with the striker 18 at loading conditions above the actuating force, whereby the second position of the displaceable element 40 would be defined by the deformed or distorted configuration of the displaceable element 40. For example, displaceable element 40 may be a portion of the housing 32 which is configured by perforating, scribing or otherwise creating an actuable seam 60 in housing 32 coincident with or defined by the perimeter 56 or one or more portions 56*a*, 56*b*, 56*c*, such that when subjected to a load above the actuating force, the actuable seam 60 partially or fully weakens, tears or separates such that the displaceable element portion 40 defined by the actuable seam 60 and housing 32 distorts so that the striker 18 enters the recess 54, which may be formed by the distortion of displaceable element portion 40.

FIG. 4 shows the displaceable element 40 in a first position, and the latching element 34 in a latched or closed position, where in the non-limiting example shown, the latching element 34 is configured as a pawl 34 which is configured to be rotatable about a pivot, shaft or swivel 36 such that the tongue 38 of the pawl 34 in a closed or latched position engages the bolt 26 of the striker 18, to provide a latching force to latch the latching mechanism 30 to the striker 18. The latching element 34 is disposed in the housing 32. The striker 18 is presented to the latching mechanism 30 for engagement with the latching element 34 along the approach path 58. Under nominal or ordinary operating conditions, the latching element 34 is the primary or main latching element engaging with the striker 18.

The striker 18, when positioned in the approach path 58 so as to be engageable with the latching element 34, may be proximate to the recess 54 and may be proximate to the displaceable element 40 and, for example, the surface 42 of the element 40. As installed and under nominal loading and latching conditions, as shown in FIG. 4, the displaceable element 40 is provided in a first position such that the displaceable element 40 prevents the bolt 26 of the striker 18 from entering the recess 54 and from engaging with the housing 32 at the recess 54.

Under higher loading conditions, e.g., higher than nominal loading conditions, a loading force may be created in the direction of the arrow 24 shown in FIG. 5, which may, for example, cause the bolt 26 of the striker 18 to move relative to the latching mechanism 30 in a direction 25, and to make contact with the displaceable element 40, for example, at a contact surface 42. The displaceable element 40 may be configured such that at loading conditions higher than nominal but below an actuating load, the displaceable element 40 may provide a resistive force to maintain the striker 18 in the approach path 58, such that below the actuating load, the displaceable element 40 remains substantially in a first position, such that the striker 18 is prevented from entering the recess 54 and/or engaging with the housing 32 at the recess 54, and the latching force is provided primarily by the engagement of the striker 18 and the latching element 34.

Above a threshold load, additional latching force may be desirable to respond to the higher loading conditions. The additional latching force may be obtained by engaging the striker 18 with the housing 32 at the recess 54, as shown in FIG. 6, to provide a supplementary or auxiliary latching force F2 which opposes movement of the latching mechanism 30 in an opening direction 23. An actuating load may be established or predetermined for the displaceable element 40, the actuating load being at or below the threshold load, whereby when the actuating load is transmitted between the striker 18 and the latching mechanism 30, the displaceable element 40 is subjected to the actuating load, for example, in the direction of the arrow 25, and is operatively displaced from the first position to a second position, shown in FIG. 5 by element 40*a*, such that the striker 18 engages with the housing 32 at the recess 54 to provide an additional latching force F2 responsive to the higher actuating load condition. When the striker 18 moves into the recess 54, the housing 32 provides or defines an auxiliary or supplementary latching element of the latching mechanism 30.

The displaceable element 40 may be displaced from its first position (see 40 in FIGS. 5 and 6) to a second position (see 40*a* in FIGS. 5 and 6) by one or a combination of deformation, distortion, disengagement, full or partial detachment, ejection, bending, tearing, ripping, compression, shearing, twisting, or means of displacement when subjected to an actuating force, such that when the displaceable element 40 is in a second position, the striker 18 and the housing 32 at the recess 54 are engageable. As shown in FIG. 5, the actuating force may be transmitted between the striker 18 and the displaceable element 40 by the striker 18 moving relative to housing 30 in a direction 25, to contact the displaceable element 40, and to exert a force on the element 40, for example, at a surface 42.

FIG. 6 shows the striker 18 engaged with the housing 32 at the recess 54 after being subjected to higher loading conditions including an actuating force sufficient to displace the displaceable element 40 to a second position, shown in a non-limiting example, at 40*a*. For clarity of illustration, the latching element 34 is not shown in FIG. 6 (see FIG. 7). The displaceable element 40 may be, in a second position, partially or fully detached from the latching mechanism 30 or may be in a distorted or deformed condition in a second position to define or provide an opening to the recess 54, when in the second position the striker 18 is engageable with the housing 32 at the recess 54. The hook 50 may be configured to retain the striker 18 in the recess 54, or to deter the disengagement or displacement of the striker 18 from the recess 54 when the striker 18 engages with the recess 54.

When the displaceable element 40 is in the second position, the striker 18 may be in the recess 54 partially or fully, with the direction, magnitude and configuration of engagement with the housing 32 at the recess 54 dependant, for example, on the configuration of the recess 54, the magnitude and direction of the higher loading conditions, the relative movement of the latching mechanism 30 and the striker 18, or a combination thereof. In the example shown in FIG. 6, the bolt portion 26 of the striker 18 has contacted or engaged with the housing 32 at a surface 52. The striker 18 may contact or engage with the housing 32 at any point along the perimeter 56 defining the recess 54, so as to be engaged with the housing 32. The engagement of the striker 18 with the housing 32 at the recess 54 provides the additional, supplementary or auxiliary latching force F2, the magnitude and direction of which may vary, for example, with the configuration of the recess 54 and/or the striker 18, and the direction and extent of engagement between the striker 18 and the housing 32 at the recess 54. A portion of the actuating force, e.g., a portion of the higher load, may be transmitted or dissipated through the housing 32 when the striker 18 engages with the housing 32 at the recess 54. The housing 32 may be configured to distort at the recess 54 in response to the actuating load, to dissipate a portion of the actuating force through the housing 32 and/or latching mechanism 30. A portion of the actuating force may be transmitted through the housing 32 to a member to which the housing 32 or latching mechanism 30 is operatively attached, which in the non-limiting example illustrated in FIG. 1 may be the first member or door 20. The engagement of the striker 18 with the housing 32 at the recess 54 during higher loading conditions may increase the latching strength of the latching system and may, by transmitting a portion of the actuating load to the housing 32, reduce the potential for deformation or distortion of latching element 34 or other elements of latching mechanism 30 during the loading event.

A method is described herein to provide additional latching force to latch a first member, shown in FIG. 1 in a non-limiting example as vehicle door 20, to a second member, shown in FIG. 1 in a non-limiting example as a portion of a vehicle body 12. The method includes operatively attaching the striker 18 to one of the first member 20 and the second member 12, and operatively attaching the latching mechanism 30 to the other of the first member 20 and the second member 12. In the example shown in FIG. 1, the striker 18 is operatively attached to a door interface portion of the vehicle body 12 through the base plate 14, and the latching mechanism 30 is shown operatively attached to the door 20. The method further includes providing the latching mechanism 30 configured as described previously herein, including the displaceable element 40 in a first position, and engaging the latching element 34 and the striker 18 to provide a latching force to latch the first member 20 to the second member 12. In a next step, the displaceable element 40 may be displaced from the first position to a second position such that the striker 18 may enter recess 54 so as to be engageable with the housing 32 at the recess 54. The striker 18 engages with the housing 32 at the recess 54 to provide an additional latching force to latch the first member 20 to the second member 12. The method may further include operatively displacing the displaceable element 40 from the first position (see 40 in FIG. 5) to the second position (see 40*a* in FIG. 5) by transmitting an actuating force between the striker 18 and the displaceable element 40, and may further include transmitting a portion of the actuating force through the housing 32 and the member 20, 12 to which the housing 32 is operatively attached when the striker 18 and the housing 32 at the recess 54 engage.

The latching system, mechanism and method described herein are illustrated using an example of a vehicle door latching system. The example of a vehicle door latching system shown in FIGS. 1-7 is intended to be non-limiting. The latching system and method described herein may be configured to provide an additional, auxiliary, or supplementary latching force between a vehicle door 20 and a door interface portion 12, where the door interface portion 12 may be a portion of a body of a vehicle 10, as previously discussed, or may be a portion 12 of another vehicle door to which the door 20 is latched or sealed. The door 20 and the other door to which door 20 is latched or sealed door may be, for example, a front side door, a rear side door, a back door, a cargo-type door, a hinged door or a sliding door, as those terms are commonly understood. Where the latching system is configured to provide an auxiliary, or supplementary latching force between a vehicle door and another vehicle door, the doors may be configured, for example, as cargo-type doors or other paired opposing hinge doors, where one door seals to the other door, and with no body pillar between the doors, to close out a continuous door opening, e.g., a door opening with no body pillar, such as a B-pillar, between the vehicle doors. The paired opposing hinged doors may be dependent or independent. As used herein, the term "dependent" refers to doors with opposing hinges on the same side of a vehicle and with no body pillar between the doors, such that the doors seal to one another, and such that a first door, usually the front door of a pair of opposing hinged doors located on the side of a vehicle, must be opened before the second door, usually the rear door of a pair of side doors, can be opened, and the second or rear door must then be closed before the first or front door can be closed. As used herein, the term "independent" refers to first and second doors which are "independently" openable and closable, which means that each can be opened or closed regardless of the position of the other vehicle door, such that each of the doors may be opened and closed in any order or simultaneously.

Further, the latching system and method described herein may be configured to provide an additional, auxiliary or supplementary latching force between any first member configured to be latched to a second member, and may be utilized in non-vehicle door applications where a latching system which may be subjected to above nominal impact loads may require additional latching force during higher loading events.

While the best modes for carrying out the invention have been described in detail, those familiar with the art to which this invention relates will recognize various alternative designs and embodiments for practicing the invention within the scope of the appended claims.

The invention claimed is:

1. A latching system comprising:

a striker; and a latching mechanism including a housing defining an approach path, a latching element and a displaceable element, wherein:

the latching element is configured to selectively engage with the striker when the striker is positioned in the approach path, such that the engagement of the latching element and the striker provides a primary latching force;

the housing defines a recess in communication with the approach path;

the displaceable element is operatively attached to the latching mechanism in a first position relative to the recess;

wherein:

the displaceable element in the first position is configured to prevent the striker from entering the recess; and the displaceable element is configured to be operatively displaced from the first position by one of detachment of the displaceable element from the latching mechanism and deformation of the displaceable element in response to an actuating force transmitted to the displaceable element, to allow the striker to engage the housing in the recess to provide a supplementary latching force.

2. The latching system of claim 1, wherein the displaceable element is configured to be operatively displaced from the first position by an actuating force transmitted between the striker and the displaceable element.

3. The latching system of claim 2, wherein a portion of the actuating force is transmitted through the housing when the striker and a perimeter of the recess engage.

4. The latching system of claim 1, wherein the displaceable element in the first position is one of proximate to the recess and operatively attached to the housing.

5. The latching system of claim 1, wherein the displaceable element is configured as a portion of housing attached to the housing in the first position by an actuable seam defined by the housing.

6. The latching system of claim 1, wherein the displaceable element is non-metallic.

7. The latching system of claim 1, wherein the displaceable element is operatively displaced from the first position by fully detaching the displaceable element from the latching mechanism.

8. The latching system of claim 1, wherein the displaceable element is operatively displaced from the first position by permanently deforming the displaceable element.

9. The latching system of claim 1, wherein the displaceable element is metallic.

10. A door latching system for a vehicle including a door and a body including a door interface portion, the system comprising:

a striker adapted to be operatively connected to one of the door and the door interface portion;

a latching mechanism adapted to be operatively connected to the other of the door and the door interface portion, the latching mechanism defining an approach path and including a housing, a latching element, and a displaceable element, wherein:

the latching element is configured to be selectively engageable with the striker, such that the engagement of the latching element and the striker provides a latching force to operatively latch the door to the door interface portion when the striker is positioned in the approach path;

the housing defines a recess in communication with the approach path; and wherein the displaceable element is operatively attached to the latching mechanism in a first position to prevent the striker from entering the recess under nominal loading conditions, and the displaceable element is configured to be operatively displaced from the first position by one of deformation of the displaceable element and at least partial detachment of the displaceable element from the latching mechanism in response to an actuating force such that the striker is engageable in the recess to provide a supplementary latching force to operatively latch the door to the door interface portion.

11. The door latching system of claim 10, wherein the striker and displaceable element are configured such that the striker is configured to transmit the actuating force to the displaceable element.

12. The latching system of claim 10, wherein the striker, the latching element and the recess are configured such that a portion of the actuating force is transmitted to the housing when the striker is engaged in the recess.

13. The door latching system of claim 10, wherein the displaceable element is a portion of the housing.

14. The latching system of claim 10, wherein the displaceable element is non-metallic.

15. The latching system of claim 10, wherein the displaceable element is configured to be operatively attached to the housing.

16. The latching system of claim 10, wherein deformation of the displaceable element is characterized by at least one of bending, tearing, ripping, shearing, and twisting the displaceable element.

17. The latching system of claim 10, wherein the displaceable element is configured for insertion into the recess in the first position and configured to be operatively displaced from the first position by at least partial ejection from the recess in response to the actuating force.

18. A method of providing a supplementary latching force to latch a first member to a second member, the method comprising:

presenting a striker attached to one of the first member and the second member to an approach path defined by a latching mechanism attached to the other of the first member and the second member;

wherein the latching mechanism includes a housing defining a recess in communication with the approach path, a latching element selectively engageable with the striker in the approach path to provide a primary latching force, and a displaceable element positioned in the latching mechanism in a first position relative to the recess;

wherein the displaceable element in the first position is configured to prevent the striker from entering the recess under a nominal loading condition;

engaging the latching element and the striker to provide a latching force to latch the first member to the second member;

transmitting an actuating force exceeding the nominal loading condition to the displaceable element, wherein the displaceable element is configured to be one of displaced from the first position by the actuating force and deformed in response to the actuating force, such that the striker is engageable with the recess; and engaging the striker with a perimeter of the recess to provide a supplementary latching force to latch the first member to the second member.

19. The method of claim 18, wherein the displaceable element is attached to the latching mechanism in the first position; and wherein the displaceable element is configured to be at least partially detached from the latching mechanism by the actuating force, such that the striker is engageable with the recess.

20. The method of claim 18, wherein the first member is one of a vehicle door and a vehicle body; and wherein the second member is the other of the vehicle door and the vehicle body.

* * * * *